US010232654B2

(12) United States Patent
Shimizu et al.

(10) Patent No.: US 10,232,654 B2
(45) Date of Patent: Mar. 19, 2019

(54) PRINTING APPARATUS

(71) Applicant: SEIKO EPSON CORPORATION, Tokyo (JP)

(72) Inventors: Tomoki Shimizu, Matsumoto (JP); Hiroyuki Kobayashi, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/799,716

(22) Filed: Oct. 31, 2017

(65) Prior Publication Data

US 2018/0126760 A1 May 10, 2018

(30) Foreign Application Priority Data

Nov. 9, 2016 (JP) ..... 2016-218645

(51) Int. Cl.

| | |
|---|---|
| ***B41J 2/01*** | (2006.01) |
| ***B41J 29/19*** | (2006.01) |
| ***B41J 29/13*** | (2006.01) |
| ***B41J 29/38*** | (2006.01) |
| ***B41J 11/66*** | (2006.01) |
| ***B41J 11/70*** | (2006.01) |
| ***B41J 13/10*** | (2006.01) |

(52) U.S. Cl.

CPC ..... *B41J 29/19* (2013.01); *B41J 2/01* (2013.01); *B41J 11/66* (2013.01); *B41J 11/706* (2013.01); *B41J 13/106* (2013.01); *B41J 29/13* (2013.01); *B41J 29/38* (2013.01)

(58) Field of Classification Search

None

See application file for complete search history.

(56) References Cited

U.S. PATENT DOCUMENTS

| | | | | |
|---|---|---|---|---|
| 6,222,608 | B1 * | 4/2001 | Shindo | G03D 15/046 355/28 |
| 2004/0017469 | A1 * | 1/2004 | Itabashi | G02B 26/125 347/245 |
| 2014/0268234 | A1 | 9/2014 | Iida et al. | |

FOREIGN PATENT DOCUMENTS

| | | | |
|---|---|---|---|
| JP | H04-71270 | U | 6/1992 |
| JP | H06-191128 | A | 7/1994 |
| JP | 2002-052778 | A | 2/2002 |
| JP | 2014-051381 | A | 3/2014 |
| JP | 2014-205343 | A | 10/2014 |

* cited by examiner

*Primary Examiner* — Matthew Luu
*Assistant Examiner* — Tracey McMillion
(74) *Attorney, Agent, or Firm* — Workman Nydegger

(57) ABSTRACT

A printing apparatus in which the movement of a moving body moving inside the housing can be known from outside the housing is provided. The printing apparatus includes a housing, a pair of rotary blades that are disposed inside the housing and move in a scanning direction, a discharge opening that is disposed at the housing so as to pass therethrough and discharges, from within the housing, a medium on which printing is performed inside the housing, and a light source that is disposed inside the housing so as to be elongated in the scanning direction. In the printing apparatus, the pair of rotary blades and the light source are disposed such that reflected light, which is the light emitted by the light source and reflected by the pair of rotary blades, exits the housing through the discharge opening.

5 Claims, 13 Drawing Sheets

PRINTING APPARATUS

CROSS-REFERENCE TO RELATED APPLICATIONS

The present application claims priority to Japanese Patent Application No. 2016-218645, filed Nov. 9, 2017, which is hereby incorporated by reference in its entirety.

BACKGROUND

1. Technical Field

The present invention relates to printing apparatuses such as, for example, ink jet printers.

2. Related Art

Ink jet printers, which are one type of printing apparatus, are widely known. Among these printers, there is one that has light sources, such as green LEDs (light emitting diodes) and red LEDs, disposed inside the frame (for example, JP-A-2002-52778). Such a printer reports to users the state of the printer by illuminating or flashing the green LEDs and red LEDs in accordance with the state of the printer and illuminating a printed sheet or a discharge tray with light emitted by the LEDs through a discharge opening.

However, the printer simply illuminates or flashes the green LEDs and the red LEDs in accordance with the status of the printer, and a user cannot know, for example, the movement of a moving body disposed inside the printer, from outside the printer.

SUMMARY

An advantage of some aspects of the invention is that a printing apparatus in which the movement of a moving body moving inside the housing can be known from outside the housing is provided.

Implementation and advantageous effects will now be described. A printing apparatus according to one aspect of the invention includes a housing, a moving body that is disposed inside the housing and moves in a moving direction, a discharge opening that is disposed in the housing so as to pass therethrough and discharge, from within the housing, a medium on which printing is performed inside the housing, and a light source that is disposed inside the housing so as to be elongated in the moving direction. In the printing apparatus, the moving body and the light source are disposed such that reflected light, which is light emitted by the light source and reflected by the moving body, exits the housing through the discharge opening.

According to this configuration, reflected light, which is light emitted by the light source and reflected by the moving body, exits the housing through the discharge opening. By seeing the reflected light that has exited, the movement of the moving body that moves inside the housing can be known from outside the housing.

In the printing apparatus, it preferable that the discharge opening include a reflection surface that reflects the light emitted by the light source to outside the housing. According to this configuration, light from the light source is reflected by the reflection surface to outside the housing so that the light from the light source can be recognized easily from outside the housing.

In the printing apparatus, it is preferable that the reflection surface include a first reflection surface and a second reflection surface both of which reflect the light from the light source in directions different from each other. According to this configuration, the light from the light source is reflected by the first reflection surface and the second reflection surface to outside the housing in different directions, so that the light from the light source can be recognized more easily from outside the housing.

In the printing apparatus, it is preferable that the discharge opening have a mouth facing inside the housing and a mouth facing outside the housing, and that the mouth facing inside the housing be located higher than the mouth facing outside the housing. According to this configuration, the medium in the housing can be readily discharged from the housing through the discharge opening, and foreign matter can be restrained from entering the housing through the discharge opening.

In the printing apparatus, it is preferable that the moving body be a cutter that cuts the medium after printing. According to this configuration, completion of printing on the medium can be indicated by enabling the movement of the cutter to be visible from outside the housing.

In the printing apparatus, it is preferable that the discharge opening be elongated to extend beside the light source, and that the light source emit a beam of light spanning a width corresponding to the width of the medium. According to this configuration, by making visible the beam of light reflected by the reflection surface of the discharge opening and spanning a given width, the width (i.e., size) of the medium for printing can be known from outside the housing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
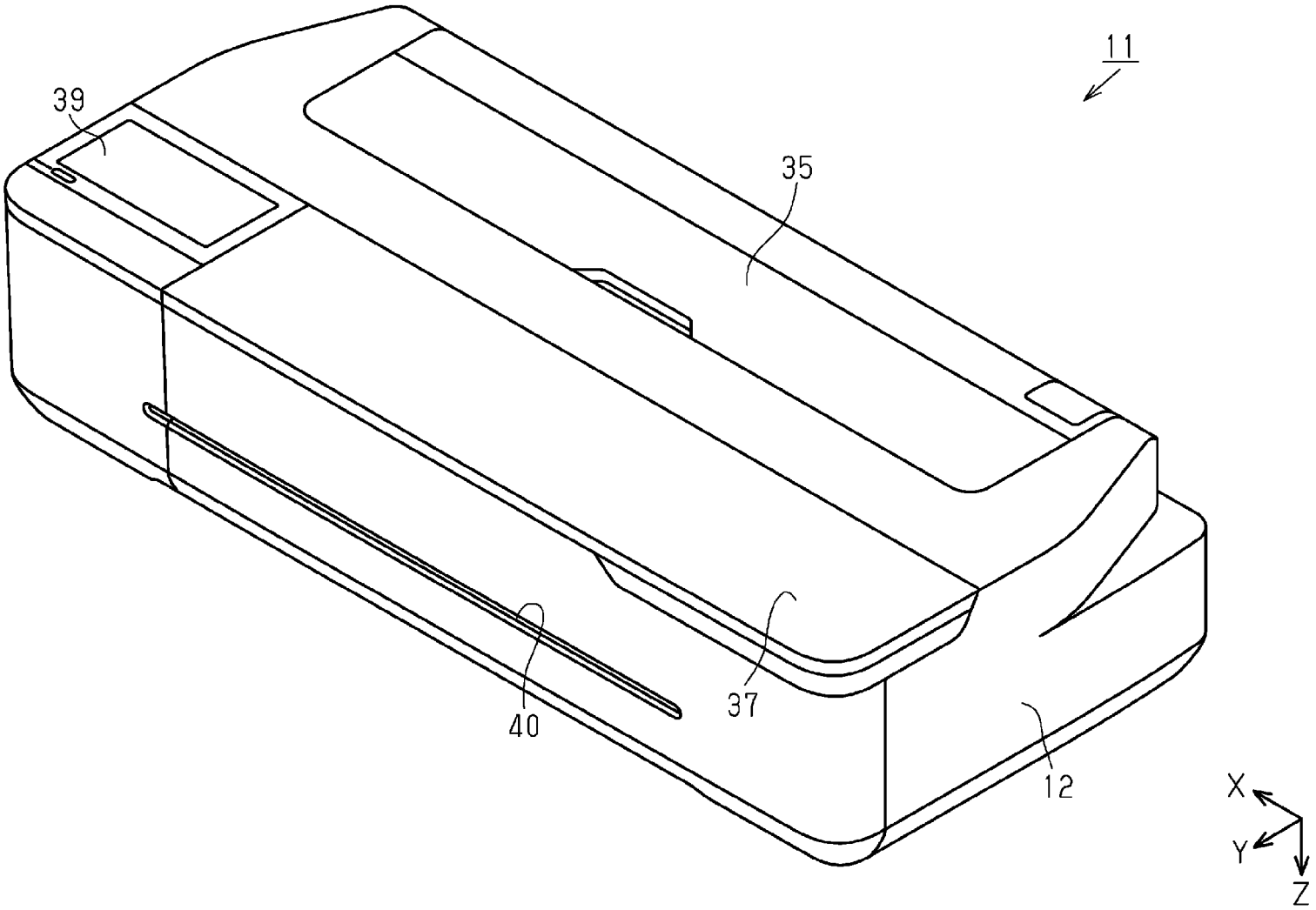
FIG. 1 is a perspective view illustrating the exterior of a printing apparatus according to one embodiment.
Figure 4:
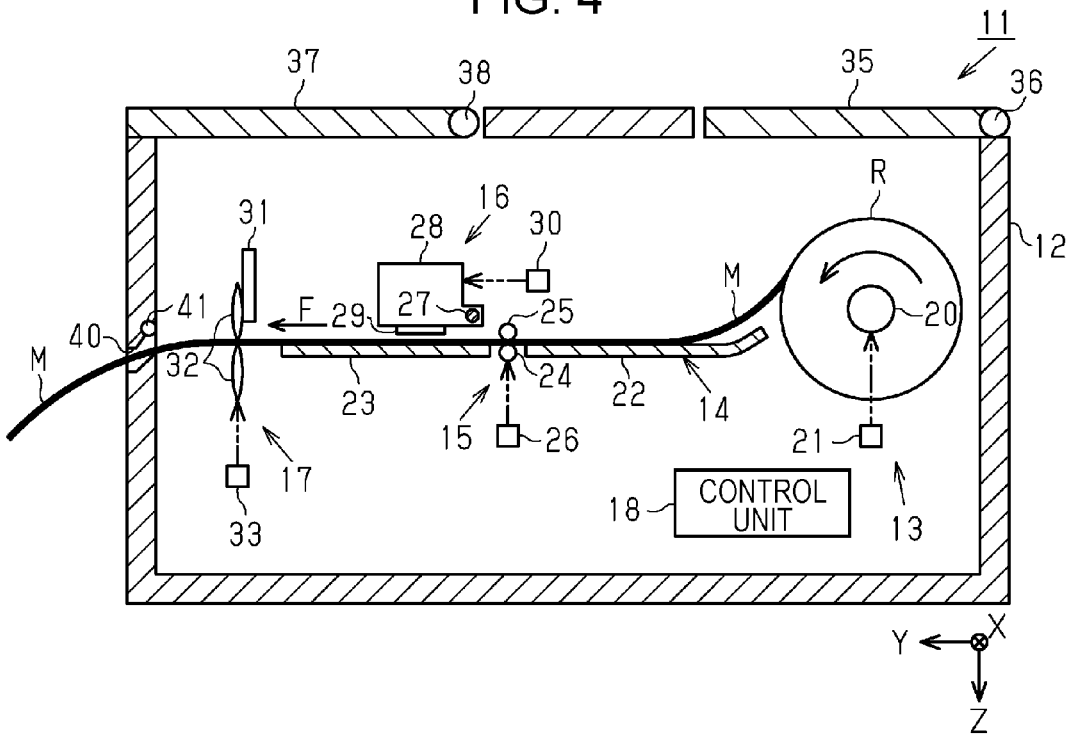
FIG. 4 is a cross-sectional side view schematically illustrating the inside of the printing apparatus.

One embodiment of the printing apparatus according to the invention will be described with reference to the drawings. As illustrated in FIGS. 1 and 4, a printing apparatus 11 includes a housing 12 that is shaped like a rectangular parallelepiped. The housing 12 includes therein a feed unit 13 that feeds a medium M, a support unit 14 that supports the medium M, a transport unit 15 that transports the medium M, a printing unit 16 that performs printing onto the medium M, a cutting unit 17 that cuts the medium M after printing, and a control unit 18 that controls these components.

Note that in the following description, the width direction of the printing apparatus 11, which is a direction in which a medium M is cut, is referred to as the "scanning direction X", whereas the depth direction of the printing apparatus 11 is referred to as the "front/rear direction Y", and the height direction of the printing apparatus 11 is referred to as the "vertical direction Z". The depth direction in which a medium M is transported is also referred to as the "transport direction F". The scanning direction X, the front/rear direction Y, and the vertical direction Z are directions that orthogonally intersect each other, and the transport direction F is a direction that orthogonally intersects the scanning direction X.

The feed unit 13 has a holder shaft 20 that rotatably holds a roll R around which a medium M is wound, and also has a first rotation mechanism 21 that drives the holder shaft 20 rotationally. The holder shaft 20, which extends in the scanning direction X, holds different types of media M or different rolls R having different lengths (or widths) in the scanning direction X. The first rotation mechanism 21 is constituted by, for example, a motor and reduction gears. In the feed unit 13, the medium M is unwound from the roll R and is fed toward a support unit 14 by rotating the roll R in one direction (i.e., counterclockwise in FIG. 4).

The support unit 14 includes a first support 22 and a second support 23 both of which constitute a transport path of the medium M from an upstream side toward a downstream side in the transport direction. The first support 22 guides the medium M that is fed from the feed unit 13 toward the second support 23, and the second support 23 supports the medium M on which printing is performed. The second support 23 subsequently guides the medium M after printing toward the cutting unit 17.

The transport unit 15 includes a transport roller 24 that exerts a force for transporting the medium M, an idler roller 25 that presses the medium M against the transport roller 24, and a second rotation mechanism 26 that drives the transport roller 24 rotationally. The transport roller 24 and the idler roller 25 are rollers having rotation axes aligned in the scanning direction X.

The transport roller 24 is disposed below the transport path of the medium M in the vertical direction, and the idler roller 25 is disposed above the transport path of the medium M. The second rotation mechanism 26 is constituted by, for example, a motor and reduction gears. In the transport unit 15, the medium M is transported in the transport direction F by rotating the transport roller 24 with the medium M nipped by the transport roller 24 and the idler roller 25.

The printing unit 16 includes a guide shaft 27 that extends in the scanning direction X, a carriage 28 that is supported by the guide shaft 27 so as to be able to move in the scanning direction X, an ejection head 29 that is supported by the carriage 28 and has a plurality of nozzles (not shown) ejecting ink onto the medium M, and a first moving mechanism 30 that moves the carriage 28 in the scanning direction X.

The ejection head 29 is a so-called "ink jet head" in which each nozzle (not shown) has an actuator (not shown), such as a piezoelectric device, that is actuated for ejecting ink from the nozzle. When the ejection head 29 is supported by the carriage 28, the opening of each nozzle is directed toward the second support 23. Incidentally, a water-based ink is adopted for the ink in the embodiment.

The first moving mechanism 30, which includes a motor and reduction gears, is a mechanism that converts the rotational power of the motor into motion of the carriage 28 in the scanning direction X. Thus, in the embodiment, actuation of the first moving mechanism 30 causes the carriage 28 with the ejection head 29 being supported thereon to move reciprocally in the scanning direction X.

The cutting unit 17 includes a guide member 31 that extends in the scanning direction X, a pair of rotary blades 32, and a second moving mechanism 33 that causes the pair of rotary blades 32 to rotate and move in the scanning direction X. The pair of rotary blades 32 constitute a cutter, which is an example of a moving body that is supported by the guide member 31 and is movable in the scanning direction X.

The second moving mechanism 33, which includes a motor and reduction gears, is a mechanism that converts the rotational power of the motor into rotation of the pair of rotary blades 32 and motion of the pair of rotary blades 32 in the scanning direction X. Thus, in the embodiment, when the second moving mechanism 33 is actuated, the pair of rotary blades 32 move in the scanning direction X with the medium M pinched between the rotary blades 32 so as to cut the medium M at a predetermined length. In the embodiment, the moving direction of the pair of rotary blades 32 corresponds to the scanning direction X.

Figure 2:
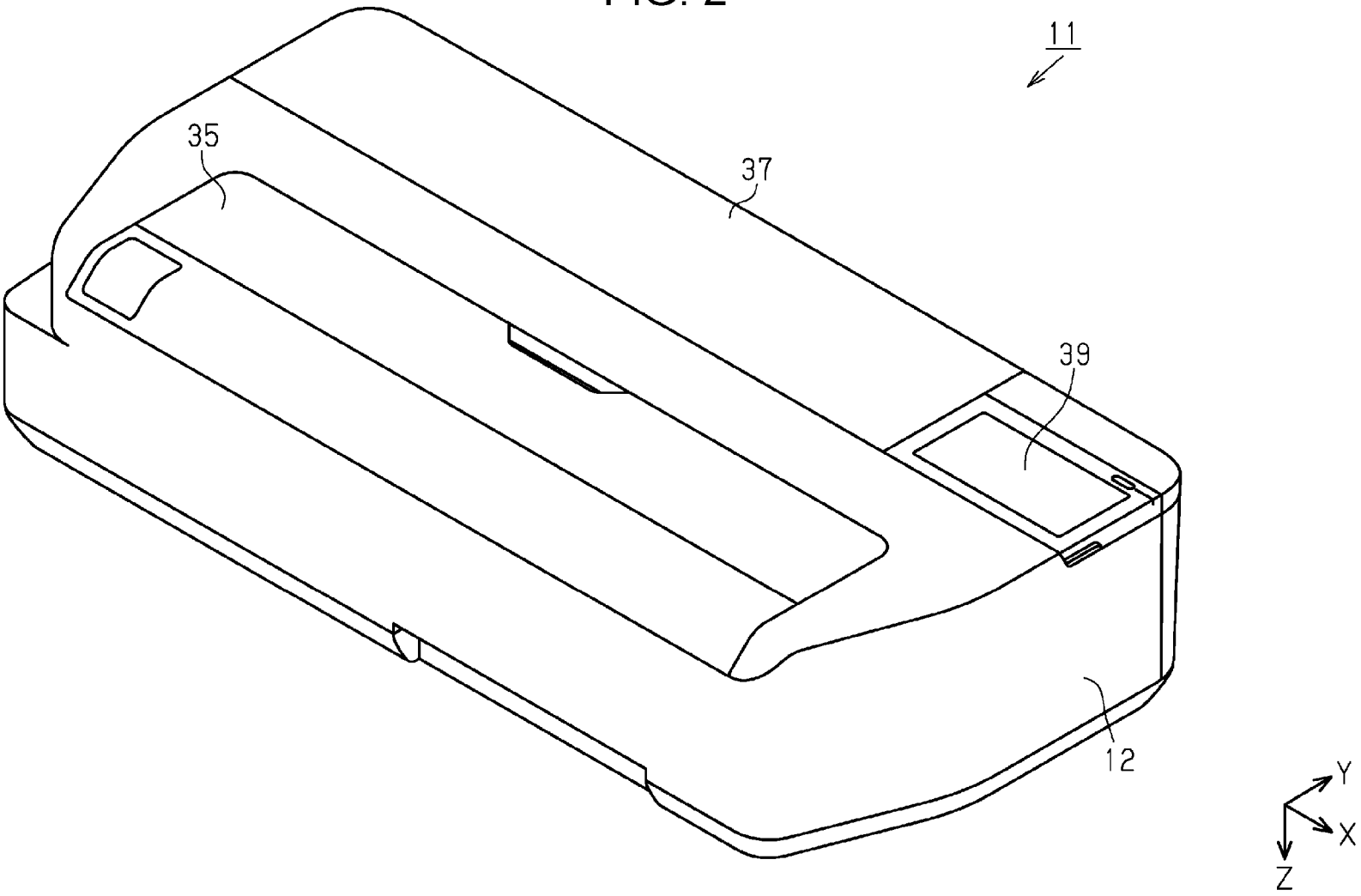
FIG. 2 is a perspective view illustrating the printing apparatus in FIG. 1 when viewed from the opposite side.

As illustrated in FIGS. 2 and 4, a first opening/closing cover 35 is turnably disposed, with a first shaft 36 being the pivot, at a rear portion of the top surface of the housing 12. The first opening/closing cover 35 is opened/closed when a roll R is set into the housing 12. Similarly, a second opening/closing cover 37 is turnably disposed, with a second shaft 38 being the pivot, at a front portion of the top surface of the housing 12. The second opening/closing cover 37 is opened/closed when maintenance operation is performed for the printing unit 16 or the cutting unit 17 within the housing 12. An operation unit 39 for performing various operations of the printing apparatus 11 is provided at a position next to the second opening/closing cover 37 in the scanning direction X on the top surface of the housing 12.

Figure 3:
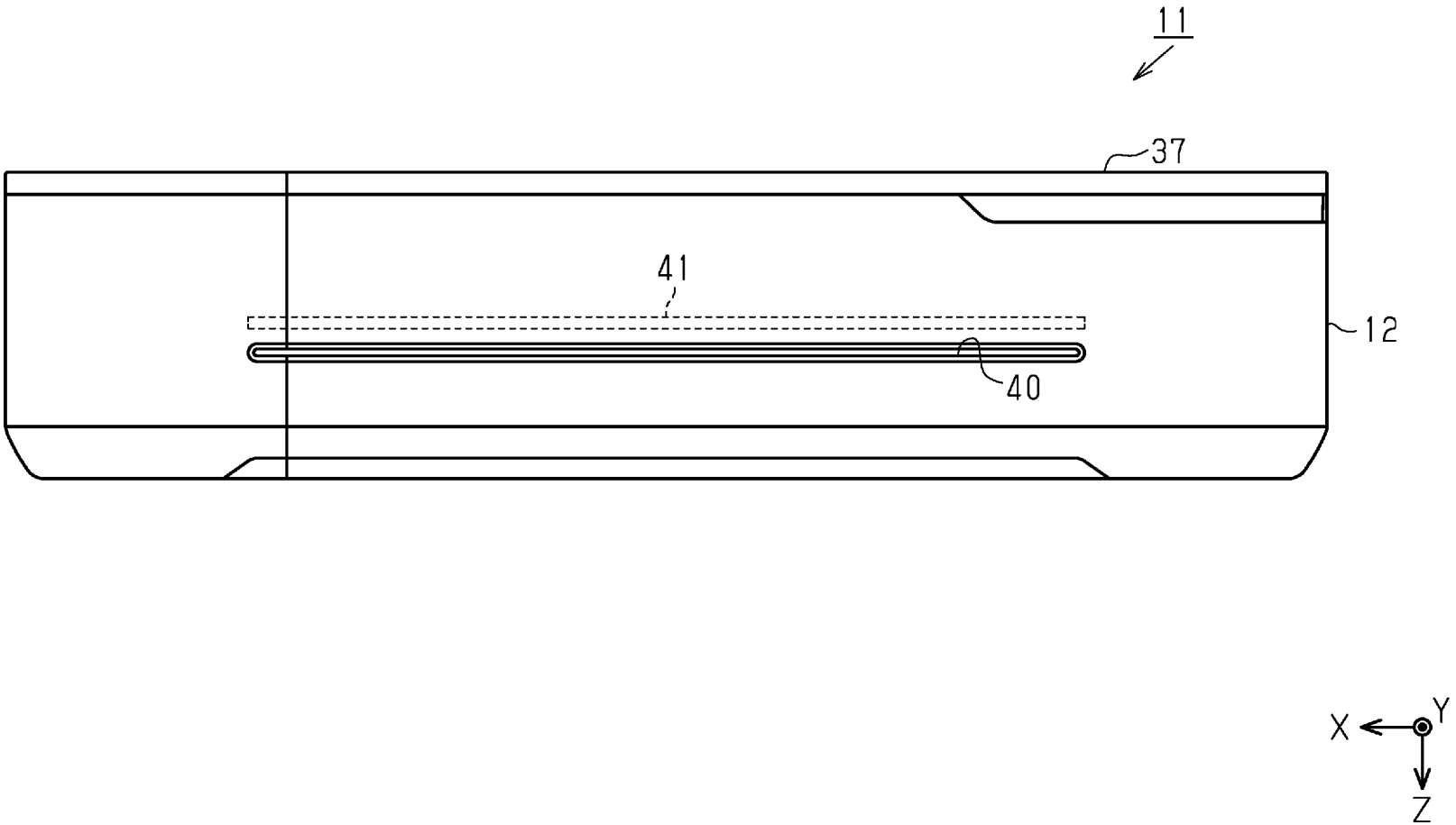
FIG. 3 is a front view illustrating the printing apparatus in FIG. 1.

As illustrated in FIGS. 3 and 4, a discharge opening 40 is provided in the front wall of the housing 12 so that the discharge opening 40 passes through the front wall in the front/rear direction Y. The medium M, which has been subjected to printing in the printing unit 16 and cut in the cutting unit 17 in the housing 12, is discharged from within the housing 12 through the discharge opening 40. The discharge opening 40 is shaped like a slit that is elongated in the scanning direction X. A light source 41 is provided inside the discharge opening 40 in the housing 12, more specifically, at an edge of the upper inner surface of the discharge opening 40, the edge being located near the cutting unit 17. The light source 41 is provided so as to be elongated in the scanning direction X. In other words, the discharge opening 40 is elongated to extend beside the light source 41.

In the embodiment, the light source 41 is formed of a tube light of LED (light emitting diode). The LED tube light is an illumination apparatus in which many LEDs with wiring are arranged in a transparent tube. The length of the light source 41 in the scanning direction X is almost the same as the length of the discharge opening 40 in the scanning direction X. In the transport direction F (i.e., front/rear direction Y), the light source 41 and the discharge opening 40 are disposed so as to oppose the moving path of each rotary blade 32. In other words, each rotary blade 32 and the light source 41 are disposed such that reflected light H1 (see FIG. 7), which is the light emitted by the light source 41 and reflected by each rotary blade 32 that moves in the scanning direction X, exits (i.e., is emitted from) the housing 12 through the discharge opening 40.

Figure 5:
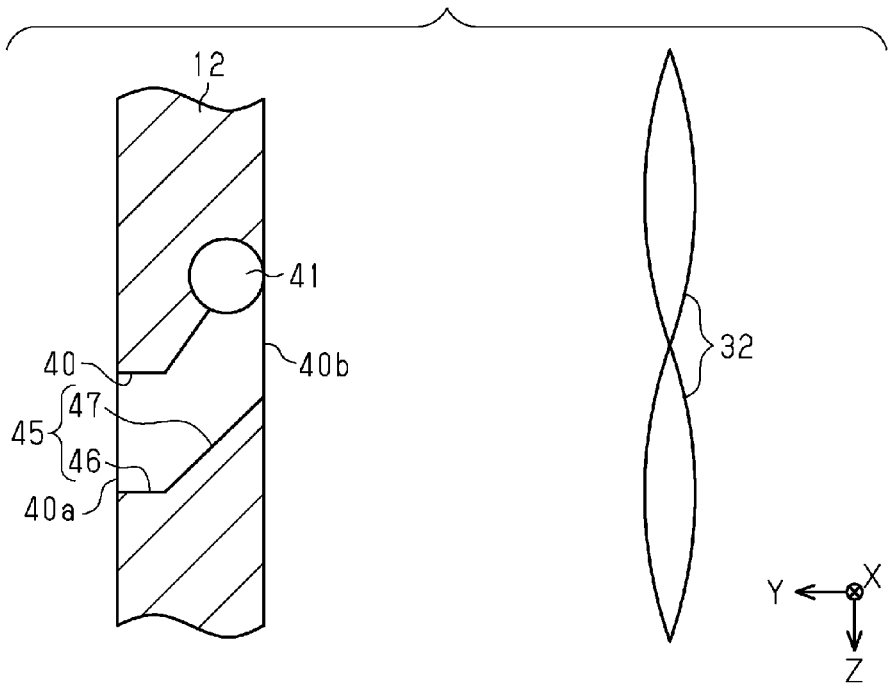
FIG. 5 is an enlarged view illustrating part of the inside of the printing apparatus in FIG. 4.

As illustrated in FIG. 5, the discharge opening 40 has a reflection surface 45 that opposes the light source 41 in the vertical direction Z and reflects light from the light source 41 to outside the housing 12. The reflection surface 45 includes a first reflection surface 46 and a second reflection surface 47 both of which reflect the light from the light source 41 in directions different from each other. In other words, the reflection surface 45 includes the first reflection surface 46 that is positioned horizontally at an edge portion of the inner surface of the discharge opening 40, the edge portion being near the outer wall surface of the housing 12. The reflection surface 45 also includes the second reflection surface 47 that extends upward from the edge of the first reflection surface 46 inside the discharge opening 40 to the edge of the inner surface of the discharge opening 40 near the inner wall surface of the housing 12.

In addition, the discharge opening 40 has an outer mouth 40*a* that faces outside the housing 12 and an inner mouth 40*b* that faces inside the housing 12, and the inner mouth 40*b* is located higher in the vertical direction Z than the outer mouth 40*a*. In other words, the discharge opening 40 extends substantially downward from the inner mouth 40*b* to the outer mouth 40*a*.

Figure 6:
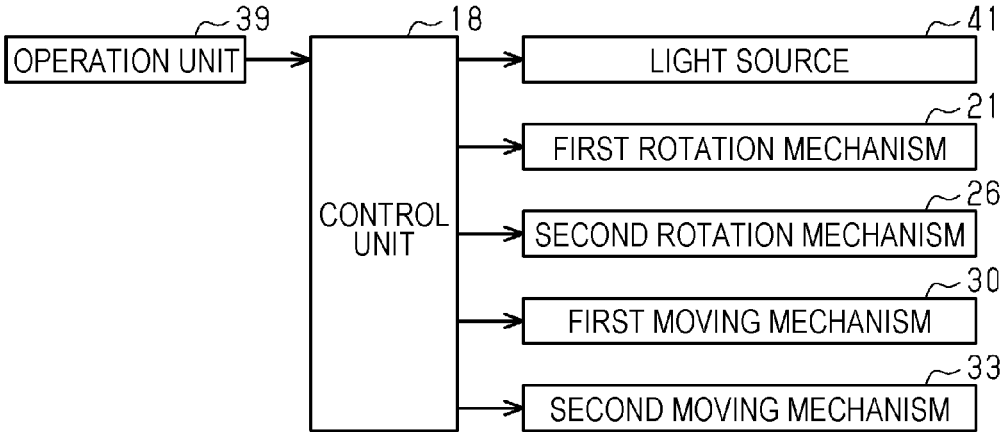
FIG. 6 is a block diagram illustrating an electrical configuration of the printing apparatus.

Next, the electrical configuration of the printing apparatus 11 will be described. As illustrated in FIG. 6, the operation unit 39 is electrically coupled to the input interface of the control unit 18. The output interface of the control unit 18 is electrically coupled to the light source 41, the first rotation mechanism 21, the second rotation mechanism 26, the first moving mechanism 30, and the second moving mechanism 33.

Next, operation of the printing apparatus 11 will be described. When a print job is input from a terminal (not shown), the control unit 18 controls operation of each component so as to perform printing on the medium M. More specifically, in performing printing onto the medium M, the control unit 18 alternately performs a transport operation, in which the transport unit 15 transports the medium M by a unit amount in the transport direction F, and an ejection operation, in which each ejection head 29 ejects ink while the carriage 28 moves in the scanning direction X.

Figure 7:
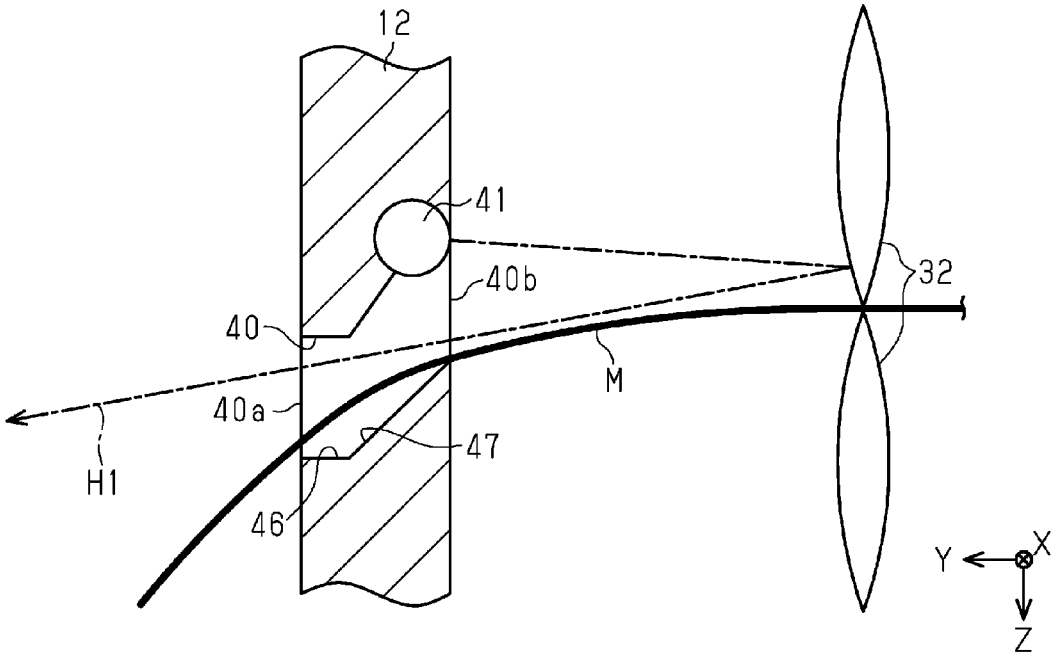
FIG. 7 is an enlarged cross-sectional view schematically illustrating a discharge opening and its vicinity when a medium is present.

Consequently, as illustrated in FIG. 7, a printed portion of the medium M is transported in the transport direction F and exits the discharge opening 40. At this time, the medium M passing through the discharge opening 40 droops by its own weight. The discharge opening 40 extends substantially downward from the inner mouth 40*b* to the outer mouth 40*a*, which suppresses the likelihood of hampering the medium M from discharging through the discharge opening 40.

When the control unit 18 actuates the second moving mechanism 33, the pair of rotary blades 32 move in the scanning direction X with the medium M pinched between the rotary blades 32 so as to cut the medium M at a predetermined length. At this time, the light that is emitted from the light source 41 and reflected by a rotary blade 32 exits (i.e., is emitted from) the housing 12 through the discharge opening 40 as reflected light H1. From outside the housing 12, a user knows the movement of the rotary blades 32 moving inside the housing 12 by seeing the reflected light H1 exiting the discharge opening 40 and recognizes, from the movement of the rotary blades 32, whether printing has been completed.

Figure 8:
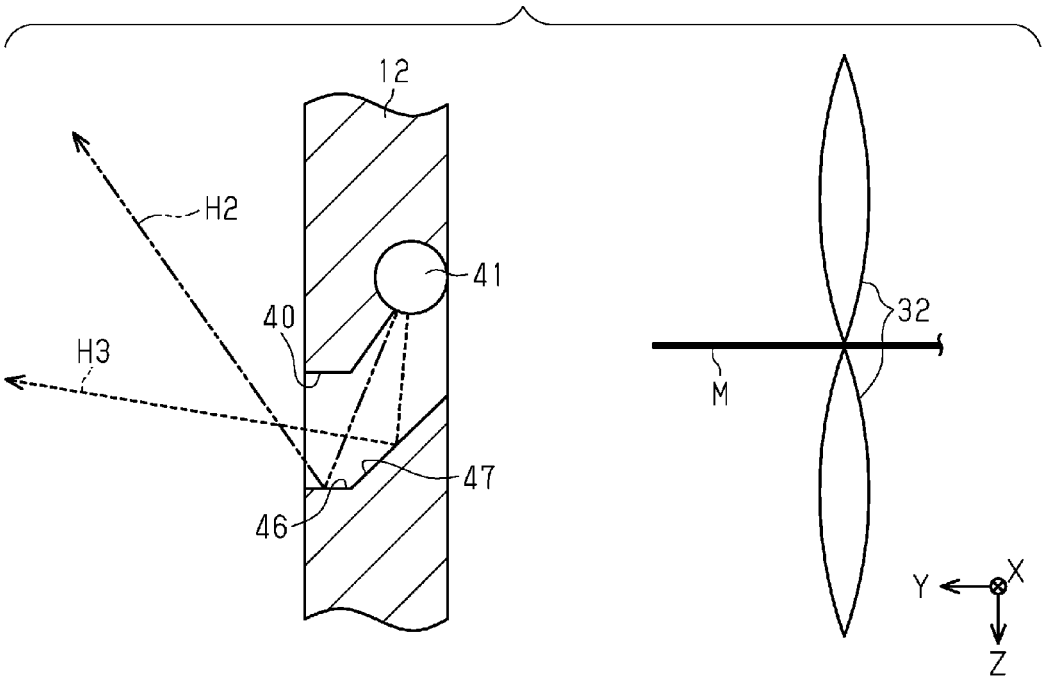
FIG. 8 is an enlarged cross-sectional view schematically illustrating the discharge opening and its vicinity when a medium is not present.

In addition, until a printed portion of the medium M that is transported in the transport direction F reaches the discharge opening 40 as illustrated in FIG. 8, the light source 41 is controlled by the control unit 18 so as to emit a beam of light having a width (i.e., the length of the beam of light in the scanning direction X) corresponding to the width of the medium M (i.e., the length of the medium M in the scanning direction X). The light emitted from the light source 41 is reflected by the first reflection surface 46 and the second reflection surface 47, and corresponding reflected light H2 and H3 exit (or is emitted from) the housing 12 through the discharge opening 40. Thus, a user can see the discharge opening 40 shining to a length corresponding to the width of the medium M. From outside the housing 12, the user knows the width (i.e., size) of the medium M currently used from the length of the shining portion of the discharge opening 40.

In accordance with the embodiment described above, the following effects can be obtained. In the printing apparatus 11, the rotary blades 32 and the light source 41 are disposed such that reflected light H1, which is the light emitted by the light source 41 and reflected by a rotary blade 32, exits the housing 12 through the discharge opening 40. Thus, by seeing the reflected light H1 that has exited the housing 12 through the discharge opening 40, the movement of the rotary blades 32 that moves inside the housing 12 can be known from outside the housing 12, and whether printing on the medium M is completed can be recognized from the movement of the rotary blades 32.

In the printing apparatus 11, the discharge opening 40 has the reflection surface 45 that reflects light from the light source 41 to outside the housing 12. Thus, the light from the light source 41, which is reflected by the reflection surface 45 to outside the housing 12, can be recognized easily from outside.

In the printing apparatus 11, the reflection surface 45 includes the first reflection surface 46 and the second reflection surface 47 which reflect the light from the light source 41 in directions different from each other. Thus, the light from the light source 41 is reflected by the first reflection surface 46 and the second reflection surface 47 to outside the housing 12 in different directions as reflected light H2 and H3, respectively, so that the light from the light source 41 can be recognized more easily from outside the housing 12.

In the printing apparatus 11, the discharge opening 40 is disposed such that the inner mouth 40*b* is located higher than the outer mouth 40*a*. This can facilitate discharge of the medium M from within the housing 12 through the discharge opening 40 and can restrain foreign matter from entering the housing 12 through the discharge opening 40. In addition, the discharge opening 40 extends substantially downward from the inner mouth 40*b* to the outer mouth 40*a*. This suppresses the likelihood of hampering the medium M that droops by its own weight from discharging through the discharge opening 40.

The printing apparatus 11 includes the pair of rotary blades 32 that move in the scanning direction X and cut the medium M after printing. Thus, completion of printing on the medium M can be recognized by seeing the movement of the pair of rotary blades 32 from outside the housing 12.

In the printing apparatus 11, the discharge opening 40 is elongated to extend beside the light source 41, and the light source 41 emits the beam of light spanning a width corresponding to the width of the medium M currently set. Thus, by seeing the width of the beam of light emitted by the light source 41 and reflected to outside the housing 12 by the reflection surface 45 of the discharge opening 40, the width (i.e., size) of the medium M for printing can be recognized from outside.

In the printing apparatus 11, the roll R is accommodated completely inside the housing 12. Thus, in the case that the roll R has an odor, the printing apparatus 11 can restrain such an odor from diffusing into the surroundings. In addition, in the case that the roll R (i.e., medium M) is formed of a sheet of paper or the like, the medium M may warp due to moisture. The printing apparatus 11 can restrain the medium M from warping due to moisture. Moreover, the printing apparatus 11 can also restrain dust, etc., from adhering to the roll R (i.e., medium M).

Modification Example

Figure 9:
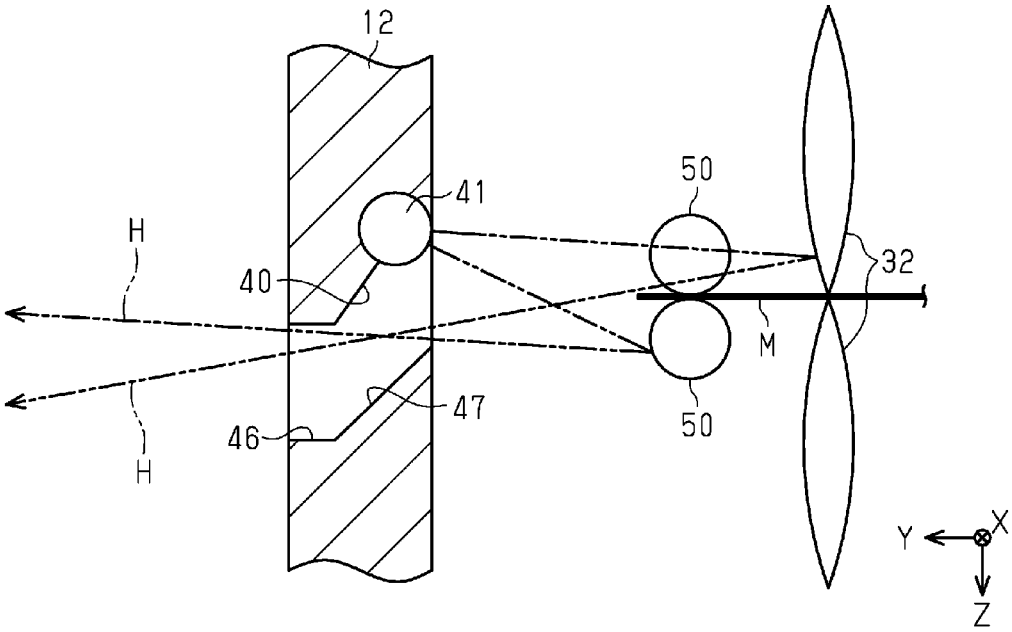
FIG. 9 is an enlarged cross-sectional view schematically illustrating a discharge opening and its vicinity in a printing apparatus according to a modification example.

The embodiments described above may be modified as follows. As illustrated in FIG. 9, the printing apparatus 11 may be configured such that a pair of guide rollers 50 that guide the medium M to the discharge opening 40 are disposed between the discharge opening 40 and the pair of rotary blades 32, and that one of the guide rollers 50 is formed of a translucent material and the other one is formed of a light-reflective material. With this configuration, light H from the light source 41 may pass through the translucent guide roller 50 and be reflected by a rotary blade 32 to outside the housing 12 through the discharge opening 40. Alternatively, light H from the light source 41 may be reflected by the light-reflective guide roller 50 to outside the housing 12 through the discharge opening 40.

Figure 10:
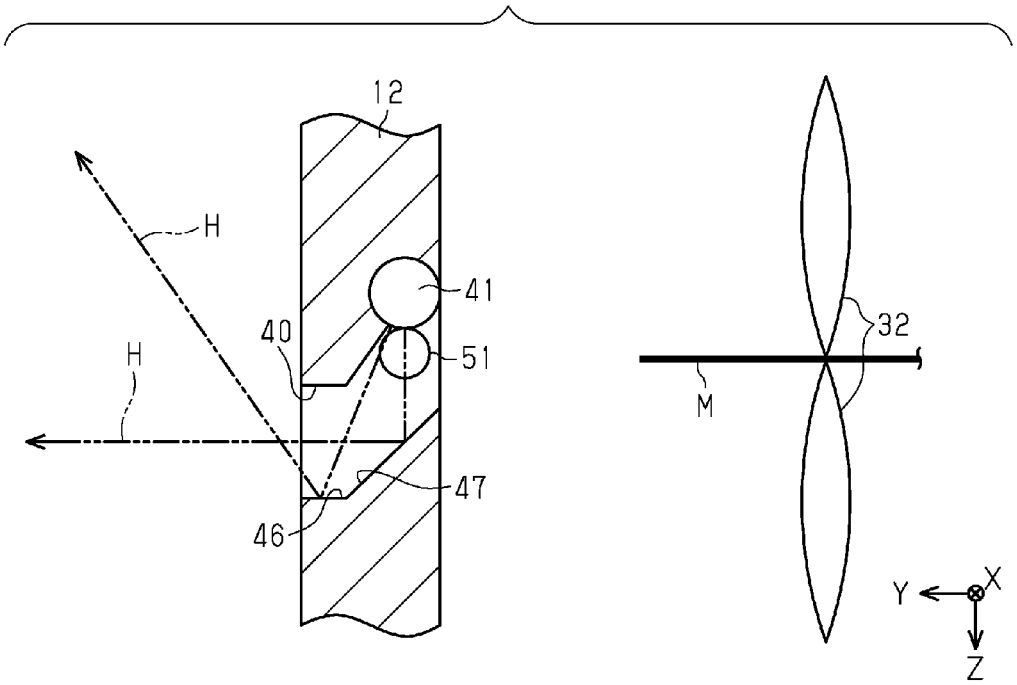
FIG. 10 is an enlarged cross-sectional view schematically illustrating a discharge opening and its vicinity in a printing apparatus according to another modification example.

As illustrated in FIG. 10, a plurality of guide rollers 51 that are arranged side by side with spacings therebetween in the scanning direction X may be disposed at positions adjacent to a bottom portion of the light source 41 inside the discharge opening 40, and the medium M may be guided toward outside the housing 12 by each of the guide rollers 51. With this configuration, light H from the light source 41 first passes through the spacings between guide rollers 51. The light H is subsequently reflected by the first reflection surface 46 and the second reflection surface 47 and emitted from within the housing 12 through the discharge opening 40. In this case, it is preferable that the guide rollers 51 be disposed such that the end positions, in the scanning direction X, of media M that can be used in the printing apparatus 11 are aligned with the positions of the spacings between the guide rollers 51 in the vertical direction Z at the discharge opening 40.

Figure 11:
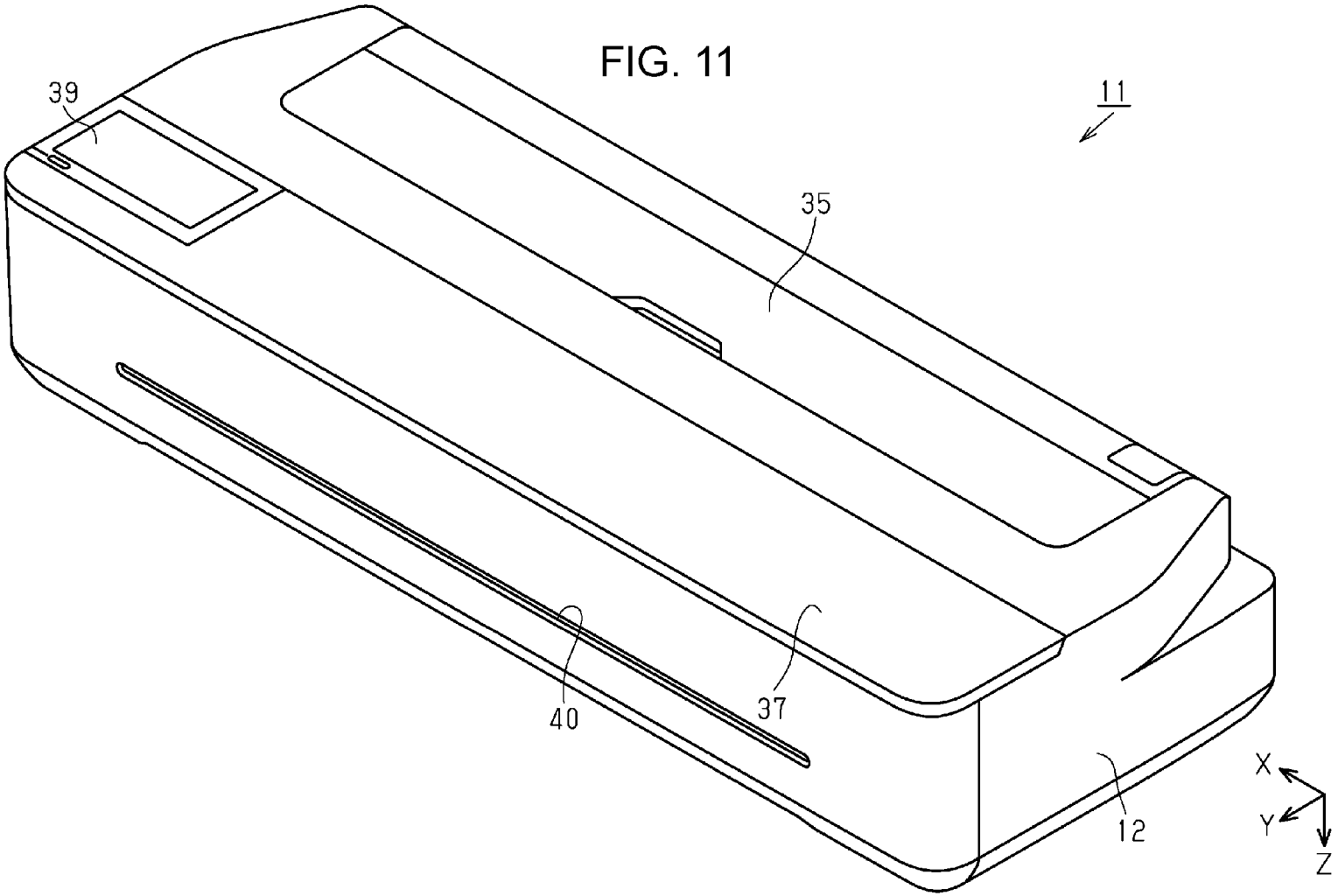
FIG. 11 is a perspective view illustrating the exterior of a printing apparatus according to still another modification example.
Figure 12:
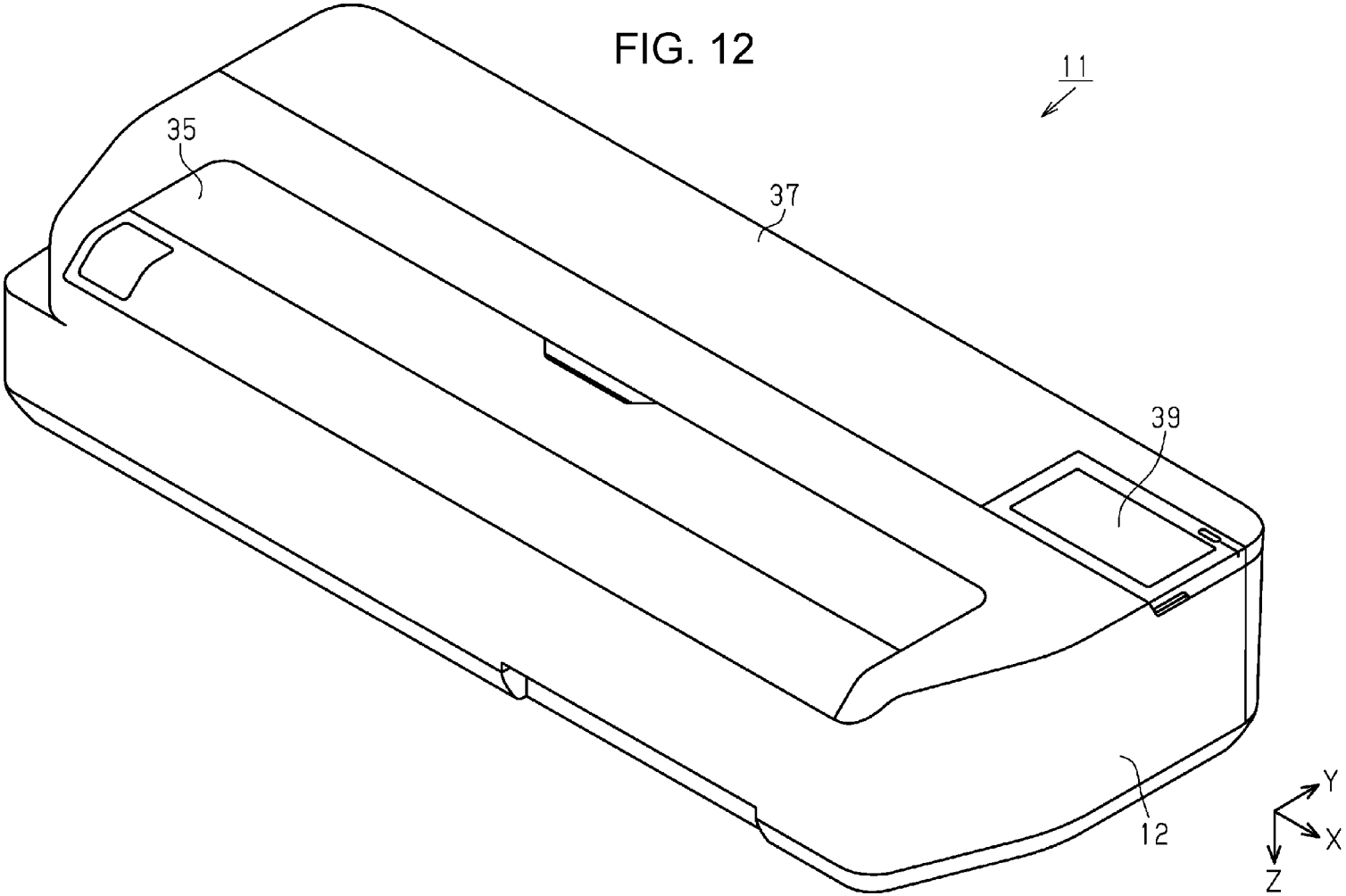
FIG. 12 is a perspective view illustrating the printing apparatus in FIG. 11 when viewed from the opposite side.
Figure 13:
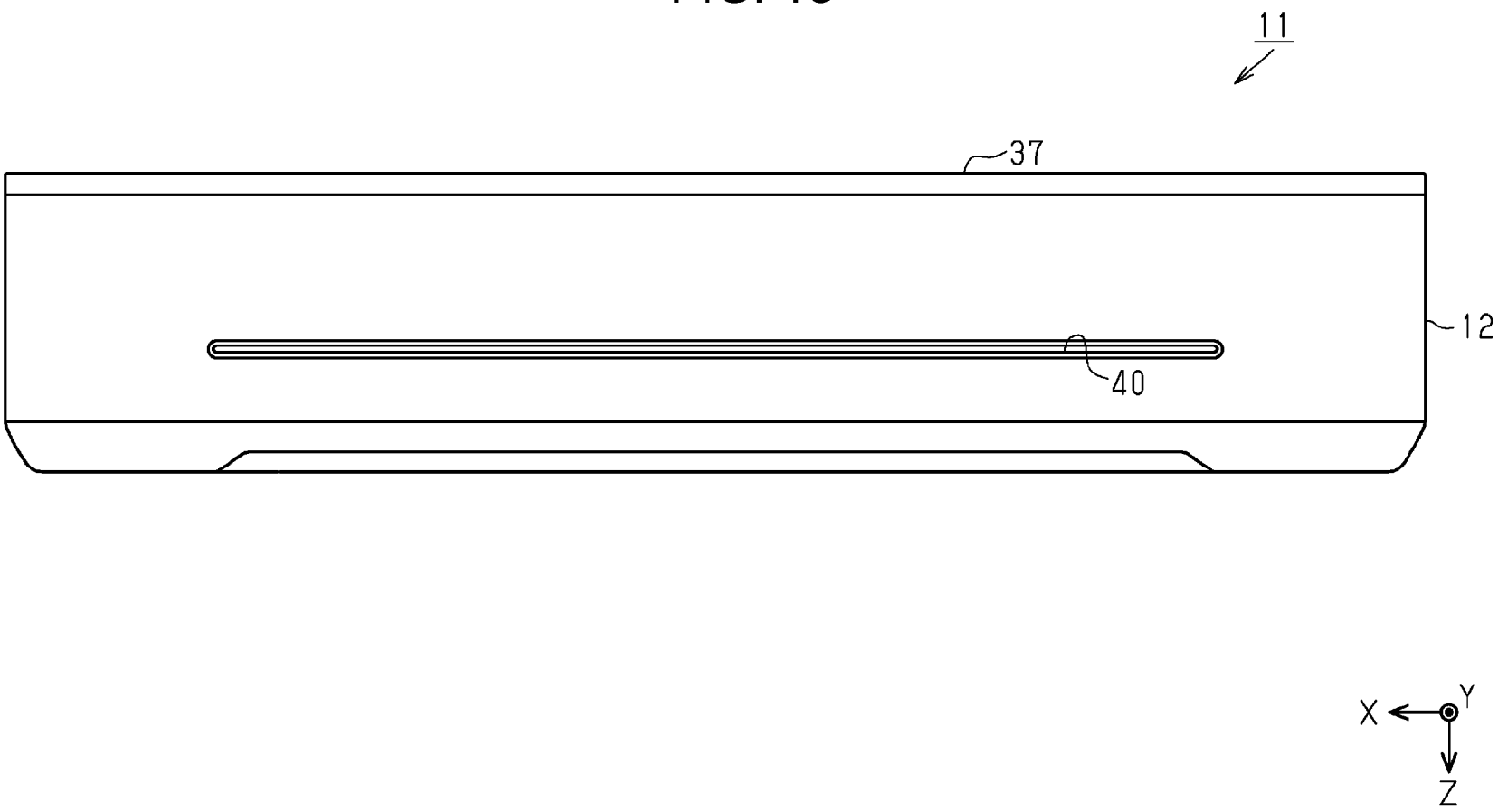
FIG. 13 is a front view illustrating the printing apparatus in FIG. 11.
Figure 14:
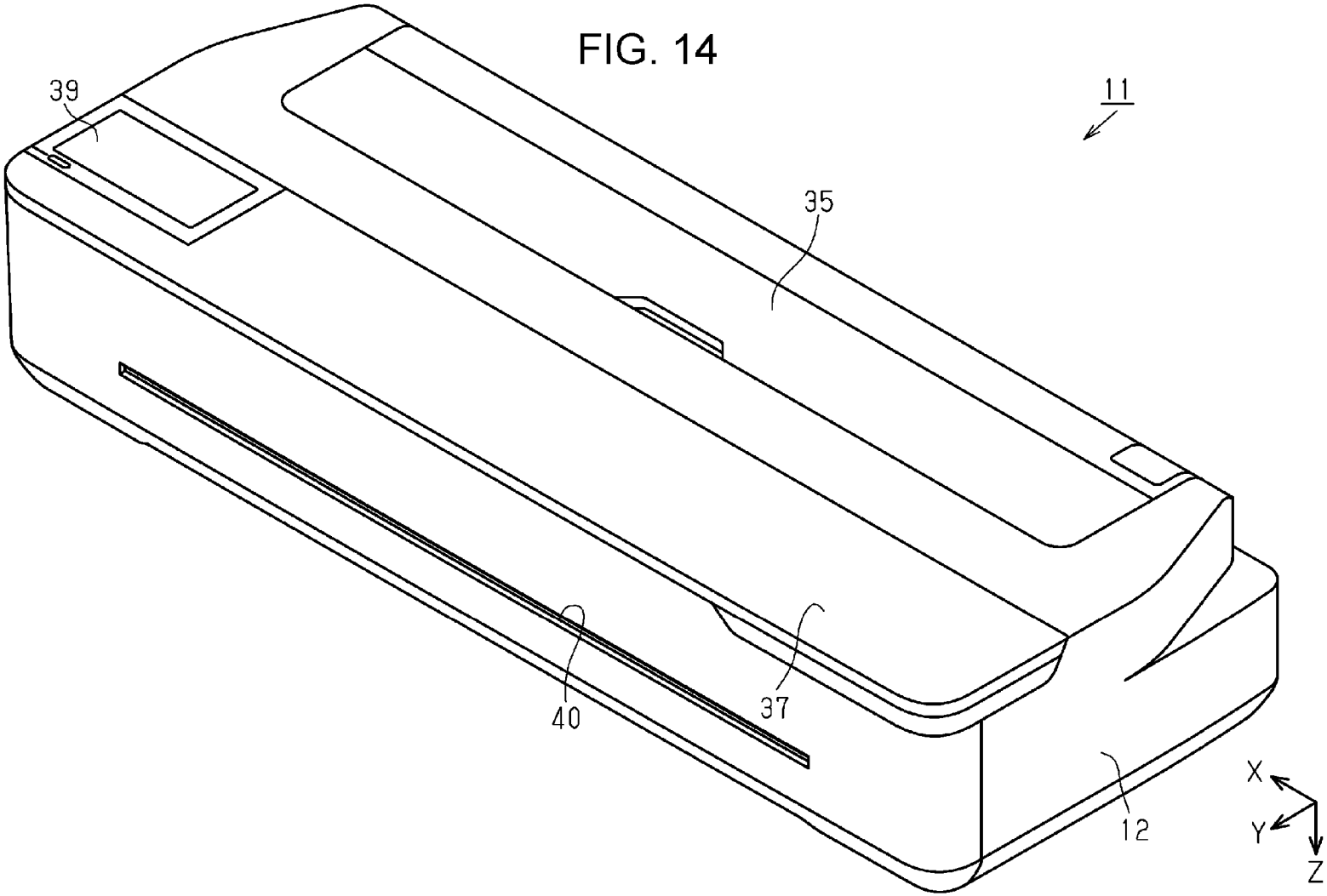
FIG. 14 is a perspective view illustrating the exterior of a printing apparatus according to still another modification example.
Figure 15:
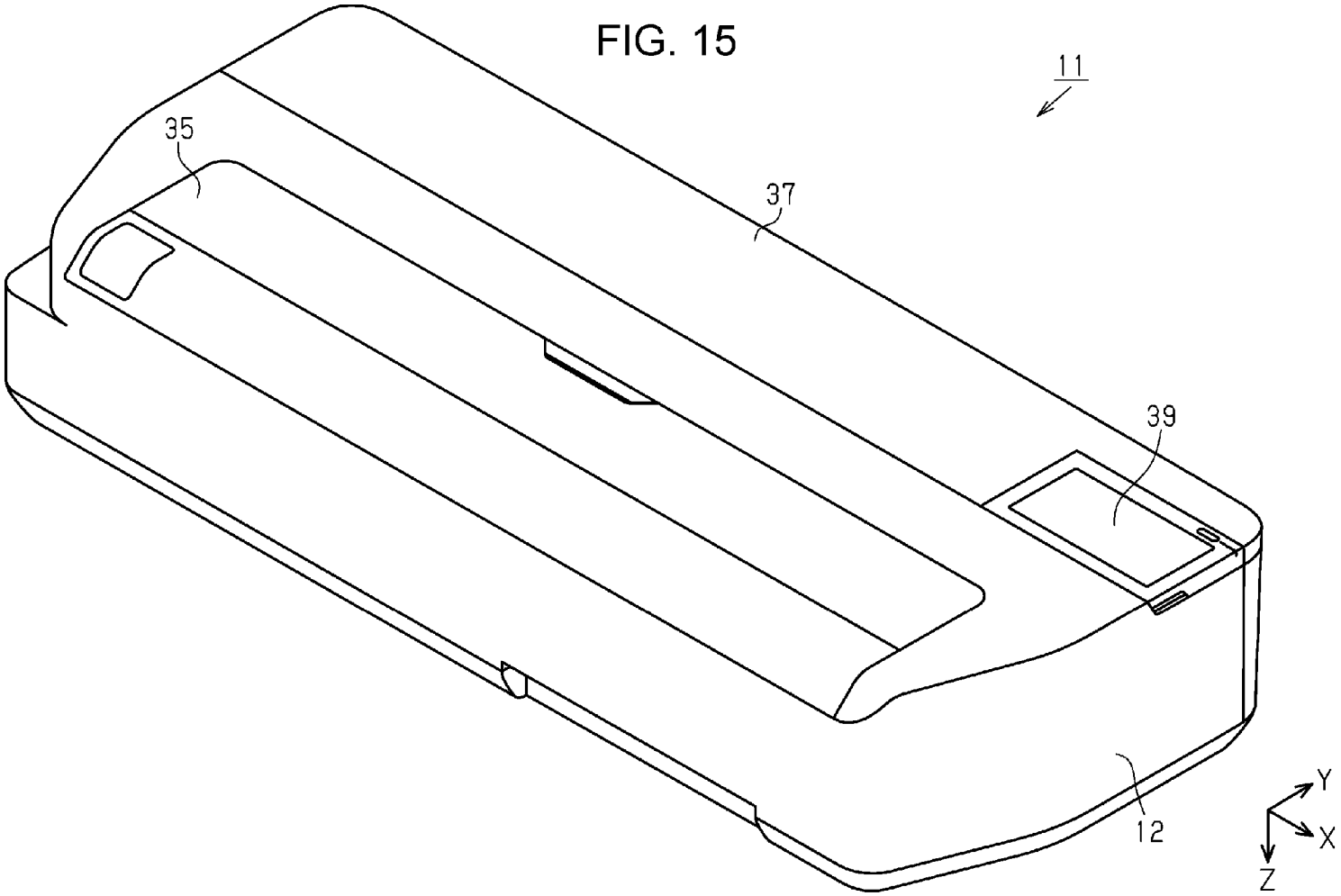
FIG. 15 is a perspective view illustrating the printing apparatus in FIG. 14 when viewed from the opposite side.
Figure 16:
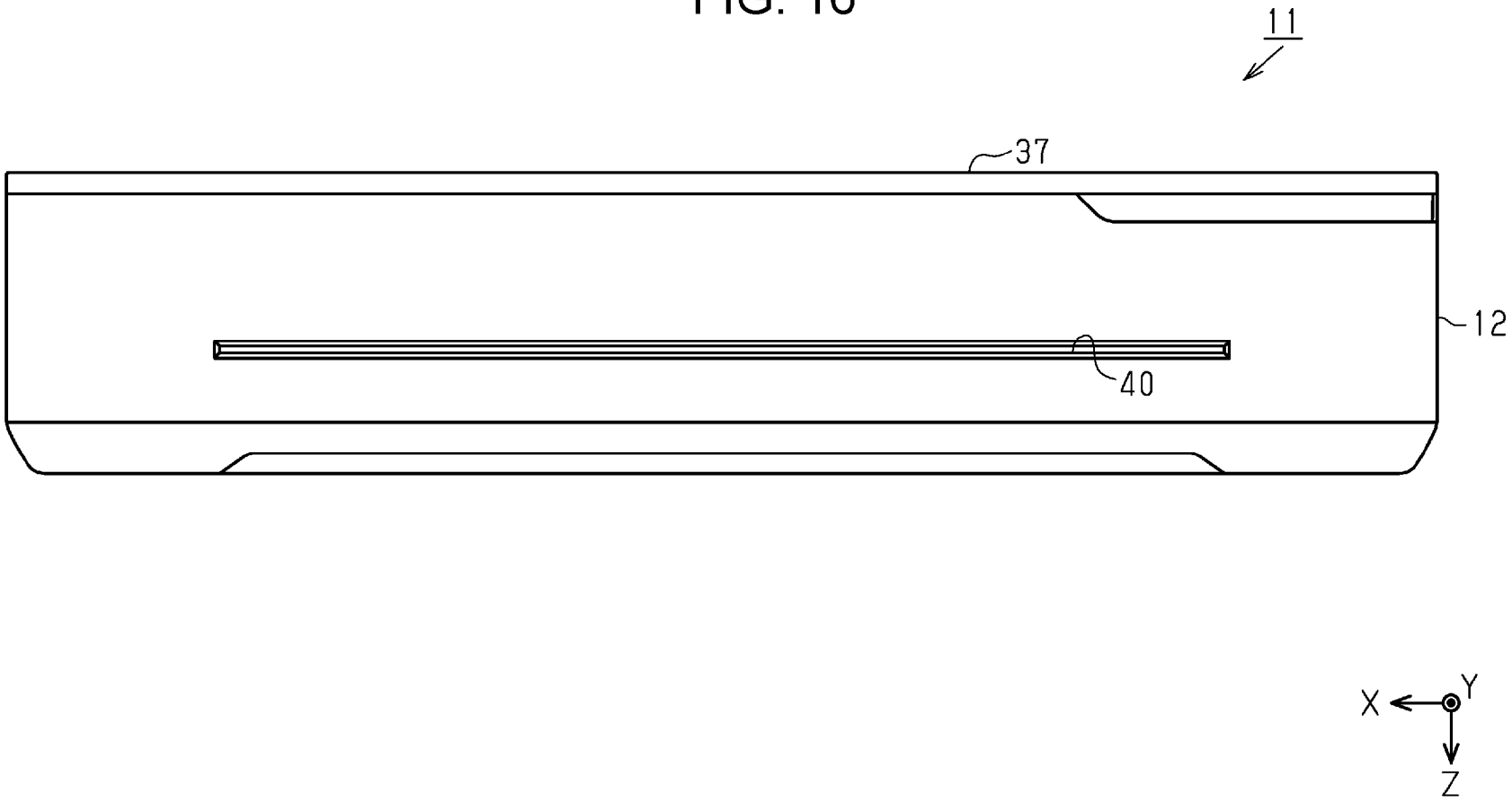
FIG. 16 is a front view illustrating the printing apparatus in FIG. 14.

The printing apparatus 11 may have an exterior illustrated in FIG. 11, FIG. 12, or FIG. 13. Alternatively, the printing apparatus 11 may have an exterior illustrated in FIG. 14, FIG. 15, or FIG. 16.

The light source 41 need not emit the beam of light spanning a width corresponding to the width of the medium M that is set currently. The moving body need not be the pair of rotary blades 32 (i.e., cutter) that cut the medium M, but may be, for example, the ejection head 29 (or carriage 28).

In the discharge opening 40, the inner mouth 40*b* need not be located higher than the outer mouth 40*a*. For example, the outer mouth 40*a* may be positioned as high as the inner mouth 40*b*.

The reflection surface 45 need not include the first reflection surface 46 and the second reflection surface 47 which reflect light from the light source 41 in directions different from each other. The discharge opening 40 need not have the reflection surface 45 that reflects light from the light source 41 to outside the housing 12.

Inside the housing 12, the light source 41 may be disposed at a position away from the front wall of the housing 12. One of the rotary blades 32 may be substituted by a straight blade that is fixed in the housing 12 and extends straight in the scanning direction X.

When a cutting error occurs in which the pair of rotary blades 32 fail to cut the medium M or when the medium M is jammed, the occurrence of an error related to the discharge opening 40 may be reported to a user by flashing the light source 41 or by changing the color of light emitted by the light source 41.

The light source 41 may be illuminated during printing operation. Thereby, it can be confirmed easily whether the printing apparatus 11 is in printing operation. The light source 41 may be illuminated like a "progress bar" in accordance with the progress of printing. This makes it easier to confirm the progress of printing.

The light source 41 may be illuminated while the pair of rotary blades 32 operate. With this configuration, the movement of the pair of rotary blades 32 is made visible from the discharge opening 40, so that the movement of the pair of rotary blades 32 can be confirmed easily.

The light source 41 may be illuminated while the medium M is discharged from the discharge opening 40. In this case, the light source 41 is illuminated, for example, in a color suitable for the medium M after printing, which enables a user to check printing results on the medium M immediately after printing. For example, when the light source 41 illuminates a yellow check pattern printed on the medium M with blue light, a user can check the check pattern easily.

The light source 41 may be illuminated in a color corresponding to a color ink and to a width (i.e., length in the scanning direction X) corresponding to the remaining amount of the color ink. With this configuration, the remaining amount of each of color inks can be checked easily.

The medium M may be a sheet of paper. In this case, the printing apparatus 11 may be configured so as to perform so-called manual-feed printing of each medium M. Note that the ratios among the height, width, and depth of the printing apparatus 11 are not limited to those illustrated in the drawings, but may be varied arbitrarily. Moreover, the location, extent, and size of the discharge opening 40 in the printing apparatus 11 are not limited to those illustrated in the drawings, but may be varied arbitrarily.

What is claimed is:

1. A printing apparatus, comprising:

a housing;

a moving body that is disposed inside the housing and moves in a moving direction;

a discharge opening that is disposed in the housing so as to pass therethrough and discharge, from within the housing, a medium on which printing is performed inside the housing; and a light source that is disposed inside the housing so as to be elongated in the moving direction, wherein the moving body and the light source are disposed such that reflected light, which is light emitted by the light source and reflected by the moving body, exits the housing through the discharge opening, and wherein the discharge opening includes a reflection surface that reflects the light emitted by the light source to outside the housing.

2. The printing apparatus according to claim 1, wherein the reflection surface includes a first reflection surface and a second reflection surface both of which reflect the light emitted by the light source in directions different from each other.

3. The printing apparatus according to claim 1, wherein the discharge opening has a mouth facing inside the housing and a mouth facing outside the housing, and the mouth facing inside the housing is located higher than the mouth facing outside the housing.

4. The printing apparatus according to claim 1, wherein the moving body is a cutter that cuts the medium after printing.

5. The printing apparatus according to claim 1, wherein the discharge opening is elongated to extend beside the light source, and the light source emits a beam of light spanning a width corresponding to the width of the medium.

* * * * *